US006435380B1

(12) United States Patent
Raboin

(10) Patent No.: US 6,435,380 B1
(45) Date of Patent: Aug. 20, 2002

(54) SELF-SEALED SPOUT

(75) Inventor: Ronald K. Raboin, DePere, WI (US)

(73) Assignee: Western Industries, Inc., Chilton, WI (US)

( * ) Notice: Subject to any disclaimer, the term of this patent is extended or adjusted under 35 U.S.C. 154(b) by 0 days.

(21) Appl. No.: 09/718,748

(22) Filed: Nov. 22, 2000

Related U.S. Application Data

(63) Continuation-in-part of application No. 09/376,597, filed on Aug. 18, 1999.

(51) Int. Cl.[7] ..... B67D 3/00

(52) U.S. Cl. ..... 222/484; 222/514; 222/523; 222/525; 141/292; 141/349; 141/351

(58) Field of Search ..... 222/484, 518, 222/522, 523, 525, 514; 141/290, 291, 292, 295, 349, 351

(56) References Cited

U.S. PATENT DOCUMENTS

| | | | | |
|---|---|---|---|---|
| 2,963,205 A | | 12/1960 | Beall, Jr. | 222/484 |
| 3,207,190 A | | 9/1965 | Silbereis et al. | 141/198 |
| 3,606,096 A | | 9/1971 | Campbell | 222/153 |
| 4,598,743 A | | 7/1986 | Milling | 141/296 |
| 4,667,710 A | | 5/1987 | Wu | 141/198 |
| 4,834,151 A | | 5/1989 | Law | 141/198 |
| 4,924,921 A | * | 5/1990 | Simmel et al. | 141/286 |
| 4,958,668 A | | 9/1990 | Vachon | 141/291 |
| 5,076,333 A | | 12/1991 | Law | 141/198 |
| 5,107,909 A | | 4/1992 | Donovan | 141/296 |
| 5,228,487 A | | 7/1993 | Thiermann et al. | 141/293 |
| 5,249,611 A | | 10/1993 | Law | 141/198 |
| 5,419,378 A | | 5/1995 | Law | 141/198 |
| 5,507,328 A | | 4/1996 | Donovan | 141/291 |
| 5,628,352 A | | 5/1997 | Gracyalny et al. | 141/98 |
| 5,762,117 A | | 6/1998 | Law | 141/198 |
| 6,257,453 B1 | * | 6/2001 | Graham | 222/153.06 |

* cited by examiner

*Primary Examiner*—Lesley D. Morris
*Assistant Examiner*—Stephanie Willatt
(74) *Attorney, Agent, or Firm*—Foley & Lardner

(57) ABSTRACT

A spout for a container comprising a conduit having a first end connected to the container, an aperture and a second end configured to be inserted into an opening. The second end of the conduit is configured to direct fluid axially out of the second end of the conduit. A closure plate extending across the diameter of the conduit for preventing flow through the conduit is provided. The closure plate has a closed position to inhibit flow through the conduit in an open position to allow flow through the conduit. A sleeve movably responsive to inserting the conduit into the opening moves the closure plate from the closed position to the open position. The sleeve is spring loaded to hold the closure plate normally closed. A vent tube having a passage is coupled to and supports the closure plate centrally disposed in the conduit. The vent tube has an inlet and an outlet with the inlet disposed in the aperture and opens into the conduit and the outlet disposed co-terminus with the second end of the conduit and permitting a flow of air from the inlet into the vent passage during a flow of fluid from the container into the opening. An end cap is coupled to the vent tube at the inlet and configured to fluidly seal the conduit in conjunction with the closed position of the closure plate.

17 Claims, 6 Drawing Sheets

FIG. 1
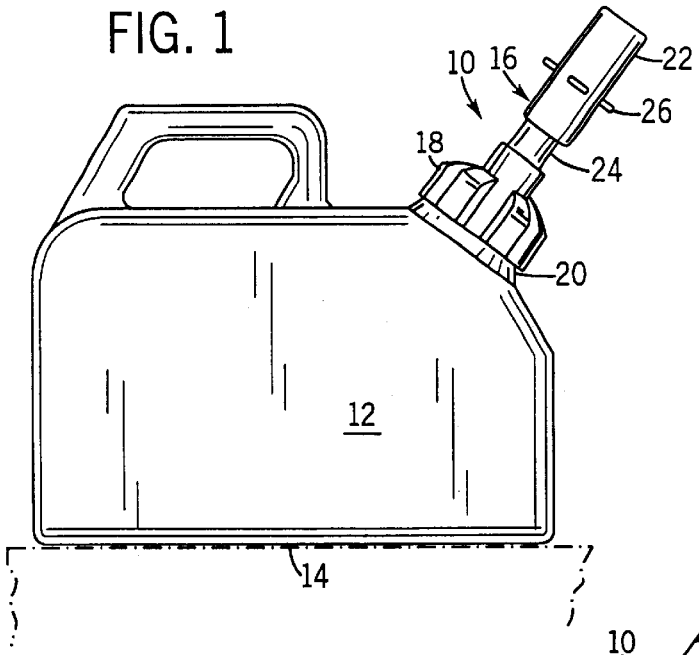
FIG. 2A
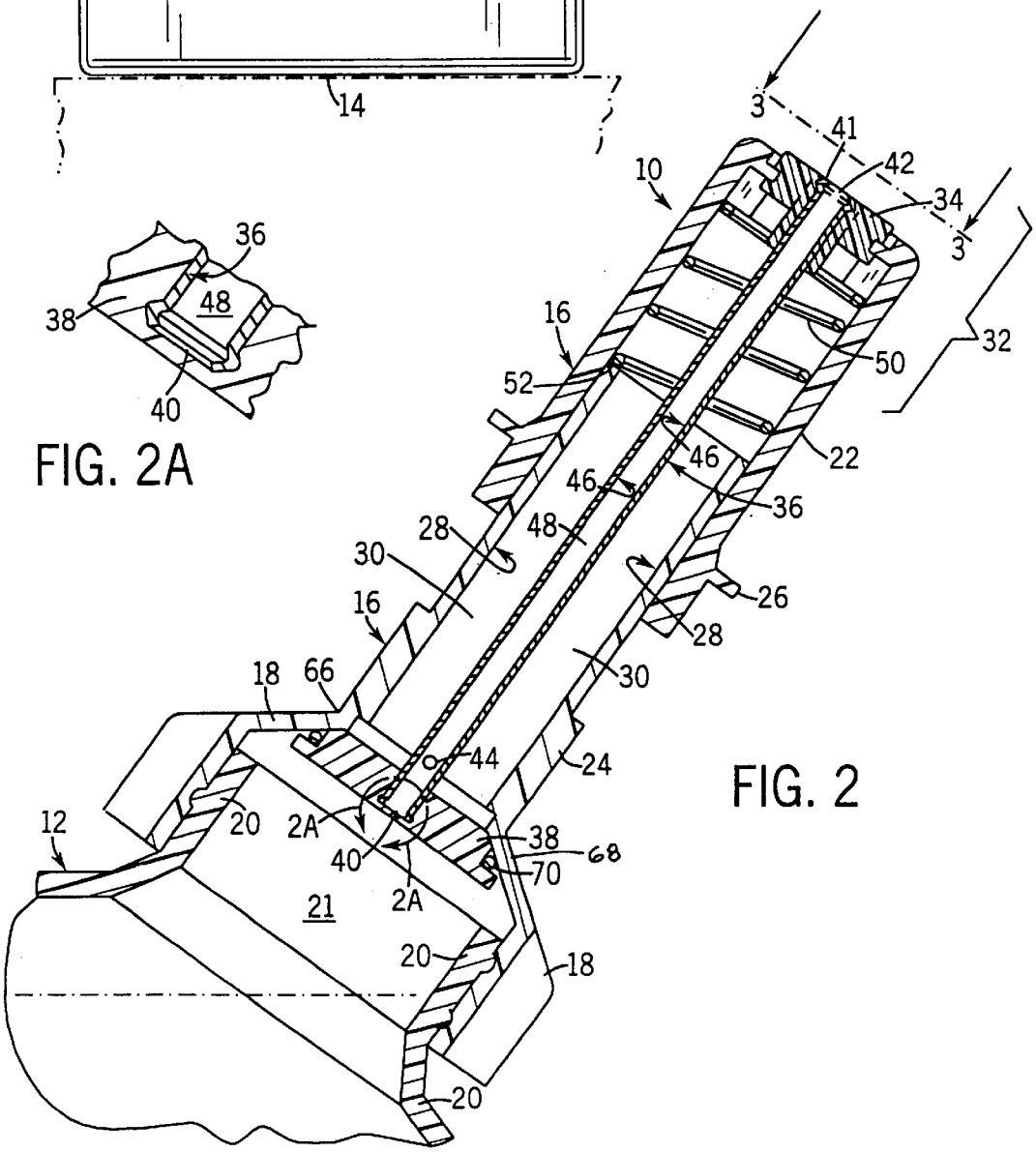
FIG. 2

FIG. 14
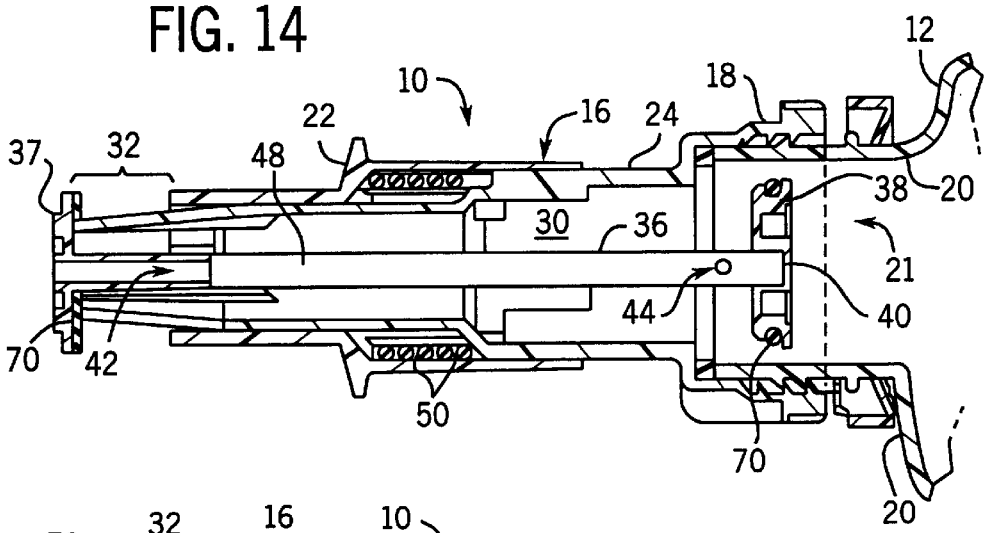
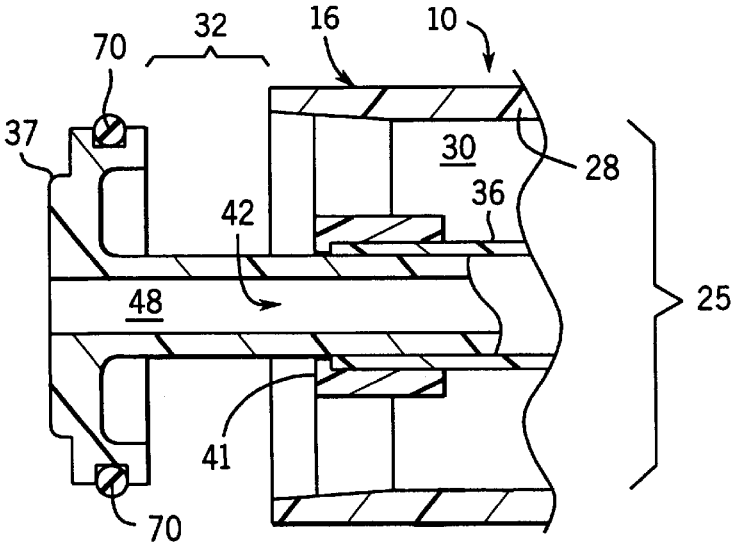
FIG. 16
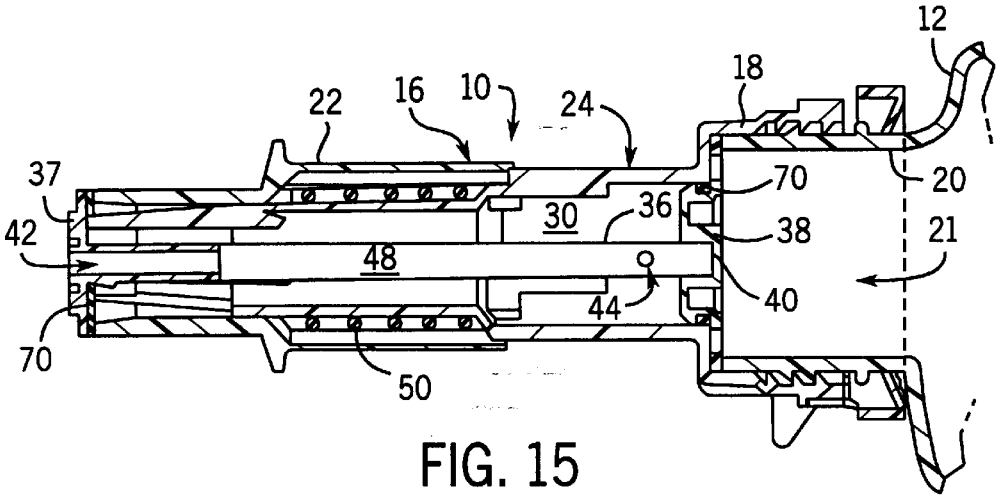
FIG. 15

FIG. 17
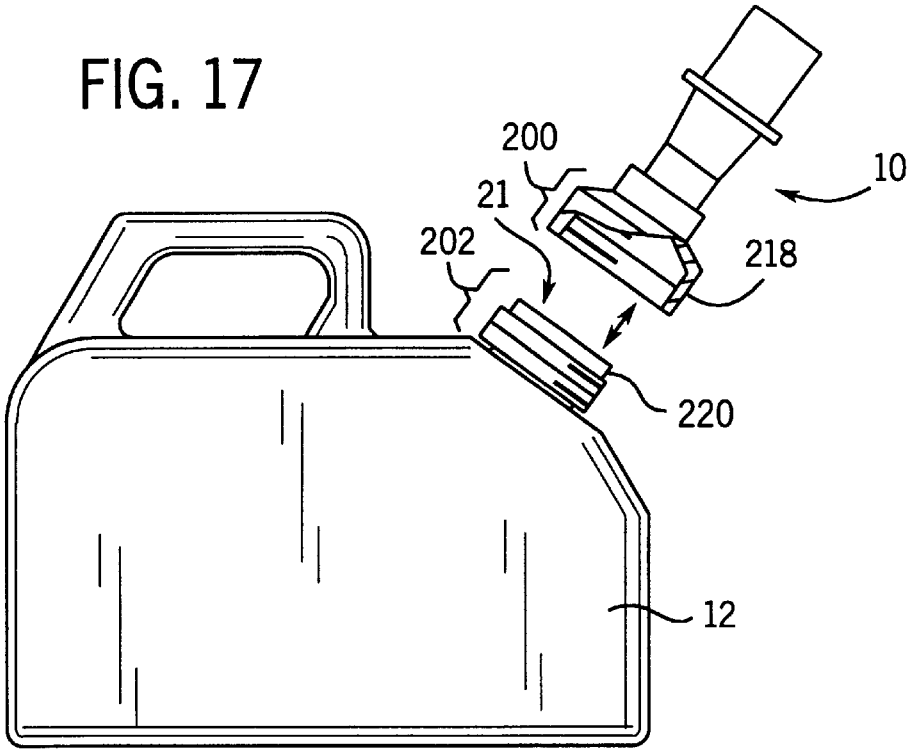
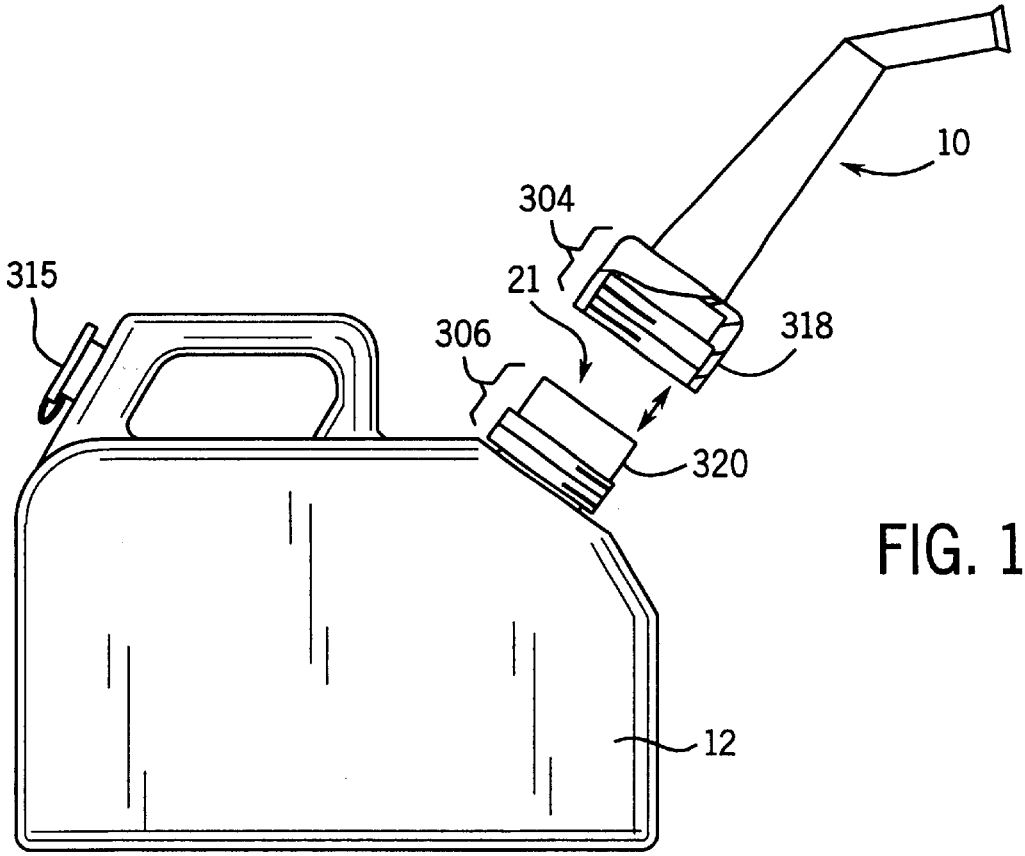
FIG. 18

SELF-SEALED SPOUT

This is a continuation-in-part of application Ser. No. 09/376,597, filed Aug. 18, 1999.

FIELD OF THE INVENTION

The present invention relates generally to a pour spout for a container. More particularly, the present invention relates to a self-sealing spout that vents air as a fluid is coincidentally poured.

BACKGROUND OF THE INVENTION

Containers used for transporting hazardous materials, such as gasoline, typically are decanted through a spout. The decanting procedure occurs when an operator is filling another container that has an opening, such as a gas tank on a lawn mower. Some jurisdictions require that a gasoline can remain sealed until the spout or nozzle is inserted into the container receiving the gasoline and then contain the fluid in the spout so as not to discharge the fluid remaining in the spout into the environment. Some existing spouts provide an end cap that must be removed before placing the spout in the receiving container opening. Some existing spouts use a ball valve at the spout's base that must be moved before decanting can occur. There are also some existing spouts that use the motion of inserting the spout into the receiving container opening to move a valve located at the base or proximate end of the spout but can't seal the distal or end of the spout in the receiving container at the completion of the decanting process, thereby allowing the fluid in the spout between the distal end and the proximate end of the spout discharge into the environment.

Thus there is a need for a spout that will contain fluid within the spout when the spout is not decanting. There is a further need for a spout that will seal by itself or automatically. There is an additional need for a spout that seals at its distal and proximate ends when not being used to decant fluid from a container. There is also a need for a self-sealing spout for a hazardous material, such as a gasoline container.

SUMMARY OF THE PRESENT INVENTION

The present invention provides a spout for a container comprising a conduit having a first end connected to the container, an aperture and a second end configured to be inserted into an opening. The second end of the conduit is configured to direct fluid axially out of the second end of the conduit. A closure plate extending across the diameter of the conduit for preventing flow through the conduit is provided. The closure plate has a closed position to inhibit flow through the conduit in an open position to allow flow through the conduit. A sleeve movably responsive to inserting the conduit into the opening moves the closure plate from the closed position to the open position. The sleeve is spring loaded to hold the closure plate normally closed. A vent tube having a passage is coupled to and supports the closure plate centrally disposed in the conduit. The vent tube has an inlet and an outlet with the inlet disposed in the aperture and opens into the conduit and the outlet disposed co-terminus with the second end of the conduit and permitting a flow of air from the inlet into the vent passage during a flow of fluid from the container into the opening. An end cap is coupled to the vent tube at the inlet and configured to fluidly seal the conduit in conjunction with the closed position of the closure plate. Another embodiment of the spout includes an end cap configured to seal the conduit within the diameter defined by the wall of the conduit.

The present invention also provides a spout for a container comprising a conduit having a first end connected to the container, an aperture, a second end adapted to be inserted into an opening and a conduit wall connecting the first end and the second end. A closure for preventing flow through the conduit is mounted in the conduit with the closure having a closed position to inhibit flow through the conduit and an open position to allow flow through the conduit. An opener movably responsive to inserting the conduit into the opening can move the closure from the closed position to the open position is also provided. The spout also includes a vent tube having a passage having an inlet and an outlet. The inlet is disposed within the aperture, with the vent tube having a passage wall between the inlet and the outlet and in contact with the conduit wall. The outlet is disposed in the vent passage for permitting a flow of air through the inlet into the vent passage during a flow of fluid through the conduit from the container into the opening. The spout also includes an end cap coupled to the vent tube at the inlet and configured to fluidly seal the conduit in conjunction with the closed position of the closure.

The present invention also provides a spout for a container comprising a conduit having a first end connected to the container, an aperture and a second end configured to be inserted into an opening. A conduit wall connecting the first end and the second end of the conduit is provided wherein the second end of the conduit is configured to direct fluid axially out of the second end of the conduit. A closure plate extending across the diameter of the conduit for preventing flow through the conduit is also provided. The closure plate has a closed position to inhibit flow through the conduit and an open position to allow flow through the conduit. An opener, movably responsive to inserting the conduit into the opening to move the closure plate from the closed position to the open position, is included with the opener holding the closure plate in a normally closed position with a spring. A vent tube having a passage coupled to and supports the closure plate centrally disposed in the conduit is also provided. The vent passage has an inlet and an outlet in a passage wall between the inlet and outlet and external to the conduit wall, with the inlet disposed in the aperture and opens into the conduit. The outlet is disposed co-terminus with the second end of the conduit for permitting a flow of air from the inlet into the vent passage during a flow of fluid from the container into the opening. The spout also includes an end cap coupled to the vent tube at the inlet and configured to fluidly seal the conduit in conjunction with the closed position of the closure plate. The spout can also be configured wherein the opener and the vent passage wall are integrally formed as a single unit. Another embodiment provides wherein the end cap is configured to seal the conduit within the diameter defined by the wall of the conduit.

The present invention also provides a spout for a container comprising a means for conducting having a first end connected to the container, an aperture in a second end configured to be inserted into an opening, wherein the second end of the means for conducting is configured to direct fluid axially out of the second end of the means for conducting. A means for closing extending across the diameter of the means for conducting for preventing flow through the means for conducting, with the means for closing having a closed position to inhibit flow through the means for conducting and an open position to allow flow through the means for conducting. A means for opening movably responsive to inserting the means for conducting into the opening to move the means for closing from the closed position to the open position is also provided. The means for opening is spring loaded to hold the means for closing normally closed. The spout also includes a means for venting having a passage coupled to and supports the means for closing centrally disposed in the means for conducting, the means for venting having an inlet and an outlet. The inlet of the means for venting is disposed in the aperture and opens into the means for conducting. The outlet of the means for venting is disposed co-terminus with the second end of the means for conducting and permitting a flow of air from the inlet into the vent passage during a flow of fluid from the container into the opening. The spout can also include a means for capping coupled to the means for venting at the inlet and configured to fluidly seal the means for conducting in conjunction with the closed position of the means for closing. Another embodiment of the spout provides the means for capping configured to seal the means for conducting within the diameter defined by the wall of the means for conducting.

There is also provided a method of preventing improper use of a spout on a container which includes the steps of providing the container with one of a first neck portion and a second neck portion and providing the container with one of a first screw cap having a first depth portion and a second screw cap having a second depth portion, wherein the first screw cap will not couple with the second neck portion to form a fluid seal between that neck portion (second neck portion) and the spout and the second screw cap will not couple with the first neck portion to form a fluid seal between that neck portion (first neck portion) and the spout. If the container is provided with an air vent, that container will be provided with the first neck portion and the first screw cap. If the container is provided with an air vent, the container is provided with the second neck portion and the second screw cap.

BRIEF DESCRIPTION OF THE DRAWINGS

FIG. 1 is a side elevational view of a conventional fluid container with the improved spout affixed to the opening of the container;

FIG. 2 is an enlarged, detailed sectional view of the spout shown in FIG. 1;

FIG. 2A is an enlarged, detailed sectional view of the spout shown in FIG. 1, taken along region 2A—2A of FIG. 2;

FIG. 14 is a sectional side view of an examplary embodiment of a self-sealing spout coupled to a container, with the end cap in the open position.

FIG. 15 is a sectional side view of an examplary embodiment of a self-sealing spout coupled to a container, with the end cap in the closed position.

FIG. 16 is a partial sectional side view of an examplary embodiment of an end cap of a self-sealing spout, with the end cap coupled to the vent tube and in the open position and configured to seal the spout conduit within the diameter defined by the wall of the conduit.

FIG. 17 is a side view of an exemplary embodiment of a container, without an air vent, with a self-sealing spout coupled to a first cap having a first depth portion configured to couple with a first neck having a first length portion on the container.

FIG. 18 is a side view of an exemplary embodiment of a container, with an air vent, with a conventional spout coupled to a second cap having a second depth portion configured to couple with a second neck having a second length portion on the container.

Figure 5:
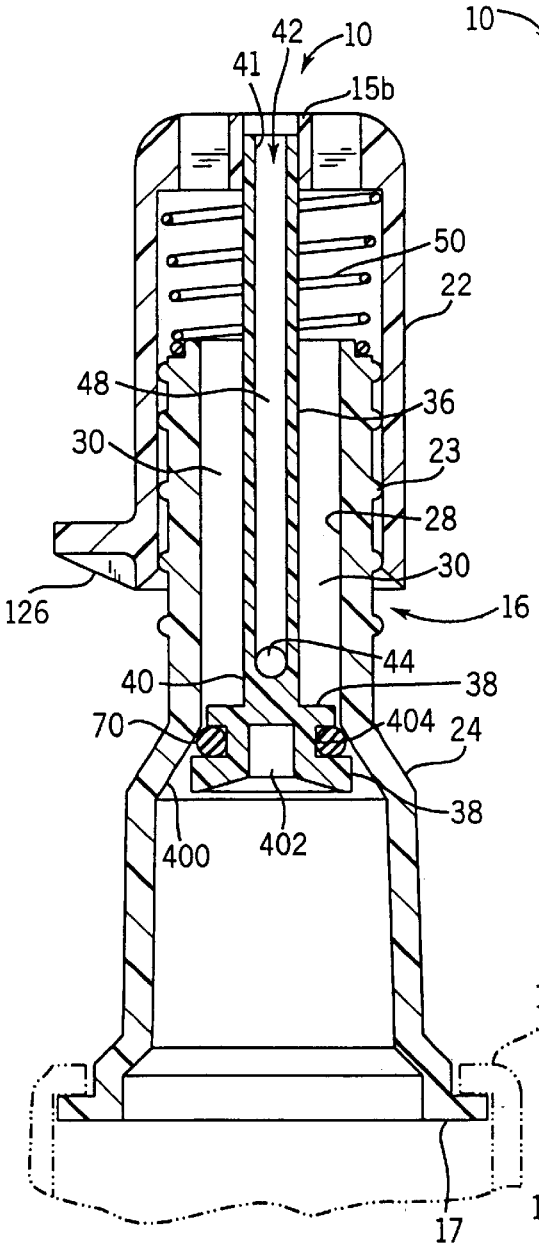
FIG. 5 is a sectional view of an alternative embodiment of the spout shown in FIG. 2, illustrating the vent tube as integral with the closure plate.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF THE PREFERRED EMBODIMENTS

With reference to FIG. 1, a spout 10 is shown affixed to a conventional fluid container 12 disposed on a horizontal surface 14. Most particularly, fluid container 12 is ventless (i.e., fluid container 12 does not have a venting apparatus). Spout 10 is typically used for pouring a fluid (e.g., gasoline) from fluid container 12 to a receiving receptacle, such as, a fuel tank of a lawn mower or other motorized vehicle.

In the preferred embodiment, spout 10 includes a conduit 16 integral with screw cap 18. Screw cap 18 is configured to rotatably affix around a neck or perimeter 20 defining an opening region 21 (FIG. 2) of fluid container 12. The neck 20 can be configured to different lengths which either accommodates or prevents a spout 10 from being used with a given fluid container 12, as explained below. Conduit 16 includes an actuating sleeve 22 telescoping over a base 24. In particular, base 24 of conduit 16 is integral with screw cap 18. Alternatively, base 24 of conduit 16 can be configured to be releasably affixed to screw cap 18. Both screw cap 18 and base 24 can be manufactured from a high-density polyethylene (HDPE) material.

As shown in FIG. 1, a plurality of spaced-apart ribs 26 circumferentially extend from the exterior surface of actuating sleeve 22. While screw cap 18 is connected to neck 20 of fluid container 12, actuating sleeve 22 is adapted for insertion into an opening of the receiving receptacle or tank. Actuating sleeve 22 is preferably made of either nylon, acetal or HDPE. Alternatively, actuating sleeve 22 can be manufactured from other resilient, corrosive-resistant materials.

As best shown in FIG. 2, an internal conduit wall 28 connects base 24 to actuating sleeve 22 and circumferentially defines a diameter of a hollow cavity or a lumen 30 within the span of conduit 16. An aperture 32 extends a distance both outwardly and inwardly (i.e., both above and below) from a terminus 34 on actuating sleeve 22. The plane containing terminus 34 is essentially perpendicular to the longitudinal access of conduit wall 28.

Conduit 16 further includes an elongated vent tube 36 affixedly passing through a valve or a closure plate 38 disposed within and substantially extending across the diameter of the lumen 30 as shown in FIGS. 2, 5, 10 and 12. More specifically, as detailed in FIG. 2A, a bottom end 40 of vent tube 36 is fixedly inserted or molded within the substance of closure plate 38 and preferably does not extend into opening region 21 of fluid container 12. In addition to bottom end 40, vent tube 36 also includes a top end 41, an inlet 42, an outlet 44 and a passage wall 46. Passage wall 46 connects top end 41 to bottom end 40 and circumferentially defines a passage lumen 48 within vent tube 36. Moreover, passage wall 46 circumferentially defines inlet 42 at top end 41. Outlet 44 is basically a hole bored through a side of passage wall 46 of vent tube 36 at a location prior to vent tube 36 contacting closure plate 38 (i.e., outlet 44 is disposed above closure plate 38 within lumen 30). In this way, outlet 44 of vent tube 36 is isolated from opening region 21 of fluid container 12 and, thus, from any fluid passing therethrough. In the preferred embodiment, outlet 44 of vent tube 36 has a diameter of 0.090 (or, a diameter ranging between 0.060 and 0.100) to provide a substantially consistent flow rate between 1.2 to 1.5 gallons per minute (GPM), is within the ASTM standard of 0.5 to 2.0 gallons per minute and, which is generally greater than the flow rates of spouts currently available.

Vent tube 36 is substantially parallel to the longitudinal axis of conduit 16. Preferably, vent tube 36 is made from either nylon, acetal, HDPE or brass. Alternatively, vent tube 36 can be manufactured from other resilient materials. A spring 50 coils around vent tube 36 at a region proximate to aperture 32, internal to actuating sleeve 22 and is biased in a direction to close closure plate 38. Furthermore, end 52 of base 24 distal to closure plate 38 physically contacts spring 50.

Spring 50 is a compression spring, and serves to push actuating sleeve 22 and base 24 apart. The separating force applied by spring 50 is opposed by closure 38, which is coupled to actuating sleeve 22 through vent tube 36. The force applied by spring 50 to actuating sleeve 22 and base 24 is transmitted to closure 38 and forces it against a sealing surface on a conical portion of base 24.

Figure 3:
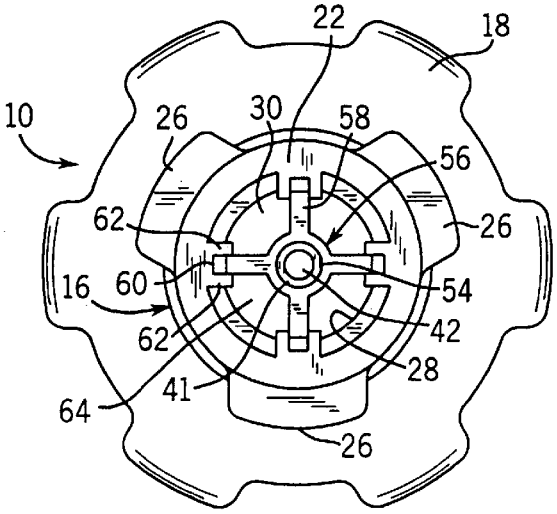
FIG. 3 is an enlarged view of the spout shown in FIG. 1, taken along line 3—3 of FIG. 2.

As shown in FIG. 3, top end 41 of vent tube 36 defining inlet 42 is preferably staked into a hole 54 centrally bordered by a multi-prong vent tube support or spider 56 having a plurality of radially-extending arms 58. In this particular embodiment, spider 56 has four arms. However, spider 56 can be any standard multi-pronged spider having any number of arms (e.g., three, six, etc.). Spider 56 is affixed to conduit 16 when each of arms 58 is inserted into a corresponding slot 60 on conduit 16. Each slot 60 on conduit 16 is defined by a pair of substantially parallel tabs 62 extending a predetermined distance from conduit wall 28 into lumen 30. Spider 56 is substantially co-terminus with terminus 34 of conduit 16. Arms 58 of spider 56, along with intervening spans of conduit wall 28 between sequential tabs 62, define a series of openings 64 that allow the flow of fluid from lumen 30 of conduit 16 of spout 10 into the receiving receptacle or tank. As an alternative to using spider 56, top end 41 of vent tube 36 can be centrally spot-welded to terminus 34 of conduit 16. Even further, top end 41 of vent tube 36 can be connected to terminus 34 of conduit 16 by an ultrasonic weld, a plastic weld, screws or other affixing means.

Figure 4:
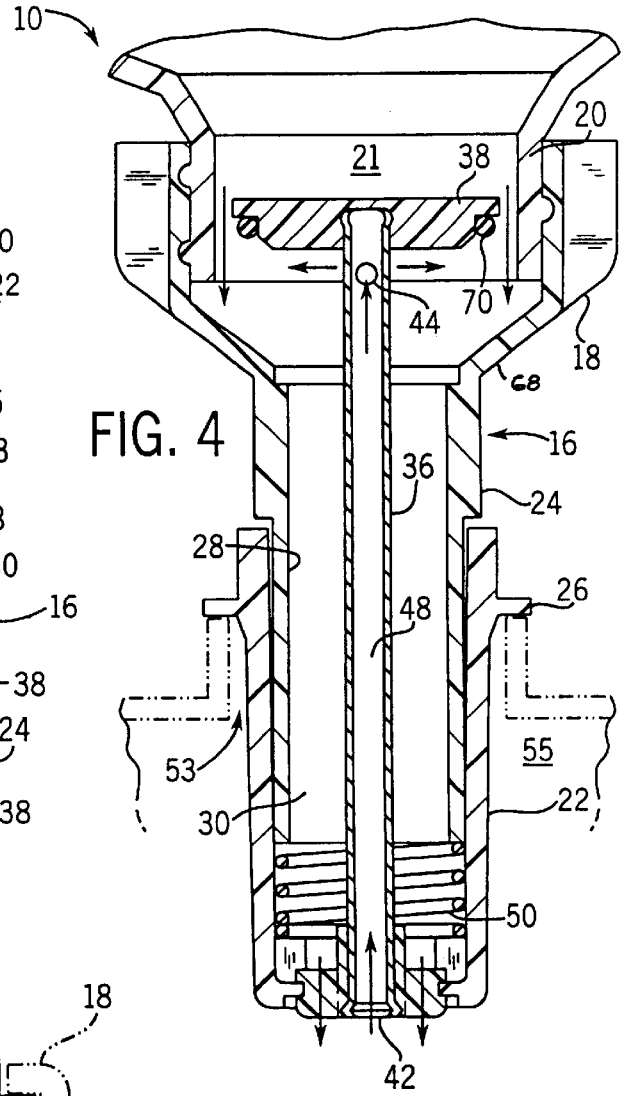
FIG. 4 is a view of the spout shown in FIG. 2, illustrating the operational position of the spout.
Figure 10:
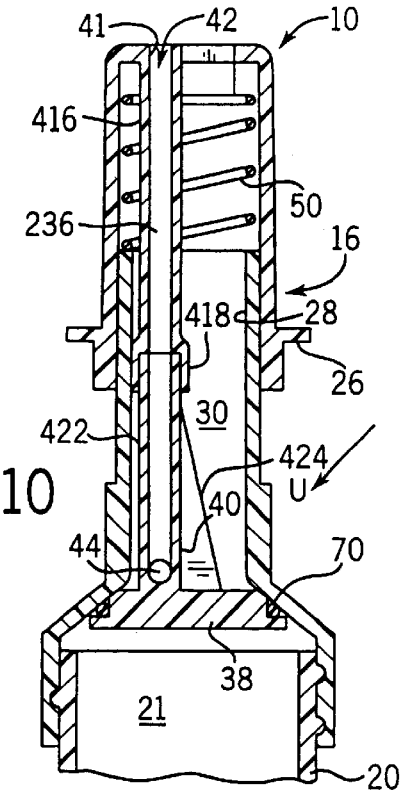
FIG. 10 is a sectional view of yet a further embodiment of the spout shown in FIG. 2, illustrating an off-centered, integral vent tube.
Figure 11:
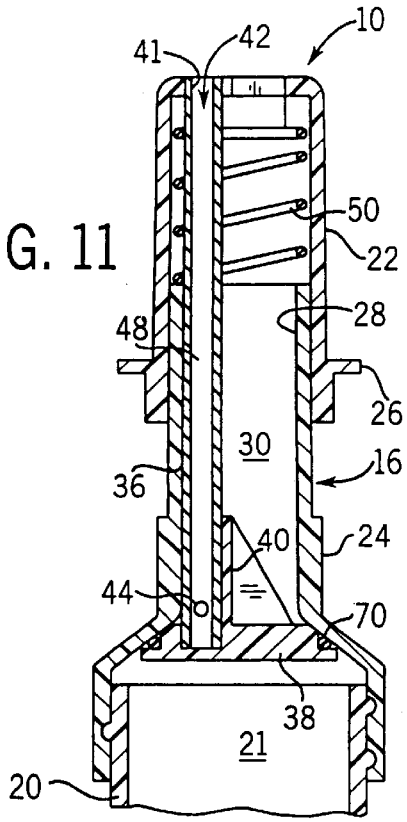
FIG. 11 is a sectional view of still a further embodiment of the spout shown in FIG. 2, illustrating a peripherally-disposed vent tube.

With reference to FIGS. 2–4, vent tube 36 in conduit 16 of spout 10 is shown as a centrally-located vent passage within lumen 30. However, in an alternate embodiment of spout 10, as best shown in FIGS. 10–11, vent tube 36 can be peripherally disposed within lumen 30 of conduit 16, i.e., off-centered.

With reference to FIGS. 24, the length of vent tube 36 and conduit 16 of spout 10 essentially extends from terminus 34 to closure plate 38.

In particular, inlet 42 of vent tube 36 is co-terminus with terminus 34 of conduit 16.

Closure plate 38 has an annular shape to provide a stopper-type effect when in contact with conduit wall 28 at a narrow-neck conical region 66 of conduit 16, where base 24 is contiguous with an expanded portion 68 of screw cap 18, in the closed configuration of spout 10. More specifically, to establish the closed configuration of spout 10, a conventional O-ring 70 is circumferentially affixed to closure plate 38.

In operation, the embodiment of FIGS. 1–4 operates in the following manner. The operator lifts the container from the position shown in FIGS. 1 and 2. He then tilts it and inserts it into an opening 53 in a receiving container 55 as shown in FIG. 4. The operator then presses down on container 12 thereby causing actuating sleeve 22 to retract over the outer surface of base 24 as tabs 26 engage opening 53. This compresses spring 50, as shown in FIG. 4.

Since closure plate 38 is fixedly mounted to an end of vent tube 36, and vent tube 36 is fixedly mounted to actuating sleeve 22, closure plate moves away from the interior wall of conduit 16 thereby providing an annular gap between closure plate 38 and the inside wall of conduit 16. Fluid flows through this gap and down through conduit 16 to fill receiving container 55.

As fluid empties from container 12, a partial vacuum is provided in container 1 that resists the flow of fluid downward. This partial vacuum pulls gas vapor from the inlet of vent tube 36 toward its outlet, then around closure plate 38 and into container 12. In this manner, since the inlet of vent tube 36 is disposed in container 55, gases such as air or volatilized liquids within receiving container 55 are transferred to container 12 and are not released to the atmosphere.

Once the tank is full to the extent that the inlet of vent tube 36 is disposed in liquid, further liquid flow out of container 12 is inhibited. The operator then lifts spout 10 out of receiving container 55. As spout 10 is lifted from container 55, spring 50 forces actuating sleeve 22 and base 24 apart until closure plate 38 seals the opening to container 12. The remaining fluid in conduit 16 drains into container 55 as the spout is withdrawn and container 12 can be returned to the position shown in FIGS. 1–2.

Referring now to FIG. 5, another embodiment is shown that is similar to the embodiment of FIGS. 1–4, but is different in several respects. First, and unlike the embodiment pictured in FIGS. 1–4, FIG. 5 shows an alternative method for attaching conduit 16 to screw cap 18 of spout 10. In FIG. 5, an outwardly facing annular flange 17 extends from the container end of the conduit and is engaged with an inwardly extending flange 19 on screw cap 18. When screw cap 18 is screwed onto neck 20 of fluid container 12, flange 19 compresses flange 17 against the top of neck 20, thereby sealing conduit 16 against the opening in the fluid container. The alternative cap and conduit arrangement of FIG. 5 permits the conduit to be redirected in several directions, by loosening screw cap 18, and to permit it to be locked in those redirected positions by tightening cap 18. This arrangement can also be employed in the embodiment of FIGS. 1–4.

Second, the conduit of FIG. 5 has a conical section 400 with a shallower taper than that of the embodiment of FIGS. 1–4. This taper, which is about 20–35 degrees, permits the use of a valve or closure plate 38 that is more cylindrical and less planar than that of the embodiment of FIGS. 1–4. This, in turn, permits a substantially U-shaped O-ring groove to be provided on plate 38. In this manner, the O-ring is held more securely to plate 38, but at the cost of reducing fluid flow rate through the conduit for a given plate diameter and for a given axial displacement of the plate. This reduced-angle conical section and the plate with a substantially U-shaped ring groove can also be employed in the embodiments of FIGS. 1–4, if desired.

A third difference between the embodiments of FIGS. 1–4 and FIG. 5 is the provision of an extended fin 126. This fin does not extend outward from around the entire circumference of the conduit, but only from one side. Due to its length the operator can engage it easily with a finger and open the spout. This is particularly beneficial when the operator is trying to fill a fluid receptacle that has a non-standard opening—an opening that is not sized to engage the fins of the FIGS. 1–4 spout. Applying finger force to a fin arranged on a single side of the spout has the adverse effect of unbalancing the forces applied to spring 50 which holds the spout closed. This twists the spout and causes unbalanced counteracting forces to be applied to the inside surface of actuating sleeve 22 by the outer surface of base 24. As a result there is increased friction applied to actuating sleeve 22, which may prevent it from being easily telescoped downward over base 24. To counteract this increased friction, raised ribs 23 are provided on the outer surface of base 24 to support the inner surface of actuating sleeve 22. These ribs are preferably formed integral with base 24 and extend circumferentially about the outer surface of base 24. They are preferably formed of a low-friction polymeric material to enhance the reduction of friction. As actuating sleeve 22 is telescoped over base 24 toward the cap, raised ribs 23 provide substantially the entire support for actuating sleeve 22. While the embodiment of FIG. 5 shows the raised ribs extending circumferentially from the outer surface of base 24, they may alternatively be disposed on the inner surface of actuating sleeve 22. If reduced friction is desired, this rib arrangement can be provided with any embodiment of the invention.

Another difference between the embodiment of FIGS. 1–4 and FIG. 5 is the provision of a single piece, integrally formed valve or closure plate 38 and vent tube 36. In the example of FIGS. 1–4, the vent tube 36 is shown as separately formed and attached to closure plate 38. Alternatively, and as shown in FIG. 5, the vent tube and closure plate can be integrally formed, preferably of a polymeric material. In this manner, assembly costs can be reduced, and additional flexibility can be provided to permit closure plate 38 to flexibly conform to conical section 400. A completely stiff vent tube would require perfect alignment between the longitudinal axis of the spider that receives the inlet end of the vent tube, and the longitudinal axis of conical section 400. If, as a result of manufacturing inaccuracies the vent tube was not formed coaxial with the base portion 24, or due to wear between the actuating sleeve 22 and base 24 became non-coaxial with the either was not coaxial with the other, the closure plate 38 and O-ring seal would be held off-center with respect to conical section 400 and would not seal tightly against conical section 400, possibly causing leakage of fluid vapors or liquid.

Since vent tube 36 and closure plate 38, being integrally formed of a polymeric material, flex sufficiently to provide proper sealing between closure plate 38 and conical section 400 even after wear occurs due to repeated sliding of actuating sleeve 22 against base 24. This construction of vent tube 36 and closure plate 38 can be applied to any of the other embodiments of the invention.

Another difference between the embodiment of FIGS. 1–4 and FIG. 5 is the provision of a recess 402 on the side of closure plate 38 facing toward the fluid reservoir. The recess extends at least partially into the plane of the closure plate that supports the O-ring. This recess has the negative effect of reducing the strength of the closure plate by thinning the closure plate in the region where it is coupled to vent tube 36. It has the positive effect of providing a more constant wall thickness of closure plate 38 in the region where the O-ring is mounted. By providing a recess, the closure plate, when molded, will cool more consistently and thus shrink more evenly, resulting in a more constant diameter of surface 404, which supports the O-ring. A more constant diameter of surface 404 will provide a more constant outer diameter of the O-ring. In this manner, the O-ring will more accurately contact the entire inner surface of conical section 400, thus providing a superior seal. This recess feature can be provided with any of the embodiments of the invention.

Another difference between the embodiment of FIGS. 1–4 is the provision of an actuating sleeve 22 having an integrally molded spider 156. Spider 156 differs from spider 56 of FIGS. 1–4 in that it is integrally molded with the outer end of actuating sleeve 22. As with spider 56 of FIGS. 1–4, spider 156 similarly provides an opening to receive and support vent tube 36 and a plurality of fluid-transmitting openings defined about the periphery of the vent tube receiving opening between the "legs" of the spider. The disadvantages of integrally molding spider 156 with actuating sleeve 22 is that the longitudinal axis of the vent tube receiving opening of spider 156 may not be concentric or coaxial with actuating sleeve 22. These problems are addressed, however, by other features of the embodiment of FIG. 5, as discussed above. This integral molding of a spider with the end of the actuating sleeve 22 can be employed with any of the embodiments of the invention.

Figure 6:
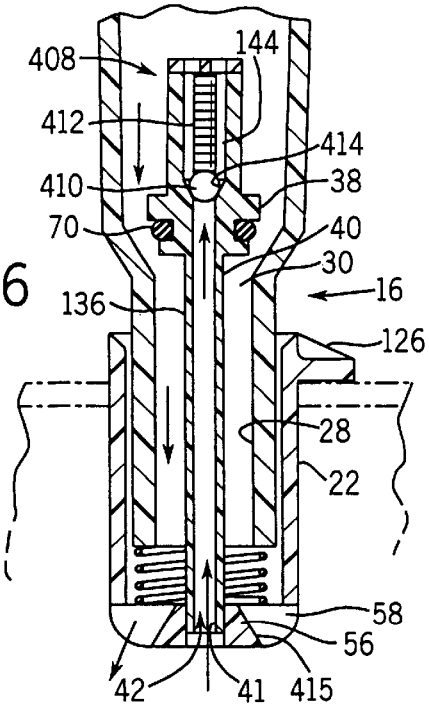
FIG. 6 is a sectional view of another embodiment of a spout shown in FIG. 2, illustrating a check valve in the closed state.
Figure 7:
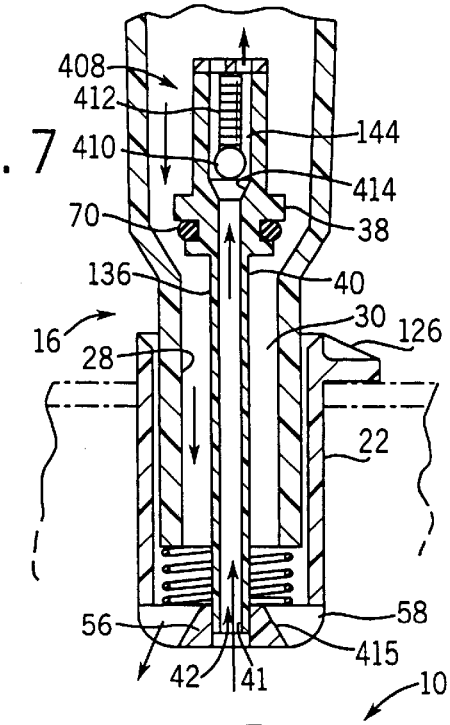
FIG. 7 is a sectional view of the spout shown in FIG. 6, illustrating the check valve in the open state.

Referring now to FIGS. 6 and 7, we can see yet another embodiment of the invention, most similar to the embodiments of FIG. 5, yet having a different arrangement of a vent tube. In the preceding embodiments, vent tube 36 terminated with its outlet opening into the interior of the conduit on the outer side of closure plate 36. In this manner, when the closure plate was closed, it would close off both vapor flow and fluid flow to or from the fluid reservoir 12. A single spring-loaded valve structure was provided to seal off both vapor and fluid flows. In the embodiment of FIGS. 6–7, in contrast, the vent tube 36 terminates with its outlet opening into the interior of the spout and on the inside—the fluid reservoir side—of closure plate 38. Since any vent tube that carries vapor through (or alternatively, around) the closure plate to the reservoir side of spout 10, it will provide a constant vapor release path past the closure plate. As a result, to prevent the flow of vapor or fluid through the vent tube when closure plate 38 is closed, a separate valve arrangement should be provided to block off vent tube 36. This is the arrangement shown in FIGS. 6–7.

FIG. 6 shows a vent tube arrangement identical to that of FIG. 5, but with the addition of a separate vent tube valve 408 disposed at the outlet end of the vent tube on the reservoir side of closure plate 38. This valve opens and closes independently of closure plate 38 to permit air to pass through vent tube 36. The outlet of vent tube 36 in this arrangement is located on the fluid side of closure plate 38, and thus, in the pouring position shown in FIGS. 6–7, blocks the flow of fluid back through the vent tube from the outlet end to the inlet end.

Advantageously, the valve is self-actuating. When fluid exits the reservoir, flowing around the closure plate and down through the conduit, it creates a partial vacuum in the reservoir at the outlet side of the valve. This reduced pressure at the outlet end is applied to the reservoir side of ball 410. The inlet end of vent tube 36 is disposed in the stream of fluid flowing from the reservoir downstream of closure plate 38. The inlet of vent tube 36 does not experience the same reduced pressure as the outlet of vent tube 36, and thus a higher, near-atmospheric pressure is applied to the inlet side of ball 410. The pressure differential across ball 410 causes it to press against spring 412, which abuts the reservoir side of ball 410 and holds it against seat 414. Spring 412 is sized to permit the differential pressure across ball 410 to lift ball 410 away from seat 414 and permit air to flow into the vent tube inlet, past the ball and into the reservoir, thus increasing the pressure in the reservoir. The pressure differential therefore lifts ball 410 away from seat 414, from the position shown in FIG. 6, wherein air flow is blocked, to the position shown in FIG. 7 wherein air is passed through valve 408 and into reservoir 12.

When the actuating sleeve 22 is released, thereby closing closure plate 38, fluid ceases to flow out of reservoir 12 past closure plate 38, and the pressure in reservoir 12 ceases to be reduced. Once sufficient air is passed through vent tube 36 into reservoir 12 to increase the reduced pressure in the reservoir back close to atmospheric pressure, there is no longer a sufficient pressure differential across ball 410 to hold valve 408 open, and valve 408 closes, preventing flow through the valve. As an added benefit, and unlike prior art vent tubes, the vent tube valve is arranged such that increased pressure within the tank increases the sealing ability of the vent valve without further adjustment. For example, if reservoir 12 contains a volatile liquid, such as a liquid hydrocarbon fuel, like gasoline, leaving the reservoir out in bright sunlight will cause it and its contents to heat up. As the liquid contents heat, they will evaporate and increase the pressure in the tank above atmospheric pressure. Spring 412 is sized to hold ball 410 against seat 414, even when inverted. Since it must be "soft" enough to permit a difference in pressure to open the valve, however, it cannot be extremely stiff. In the present arrangement, however, this is not a problem. As the pressure differential rises within the tank, it applies an increased pressure against the reservoir side of ball 410. Since an essentially unchanging atmospheric pressure will act upon the inlet side of the ball, this increases the net force of seat 414 against ball 410, causing an even tighter valve seal. As the reservoir heats up, the degree of sealing of valve 408 increases proportionally as a function of the pressure differential applied across the valve. The pressure differential and hence the pressure of the ball against the seat can be quite large. For this reason, valve seat 414 is preferably disposed in a central location in closure plate 38, preferably along the longitudinal axis of closure plate 38, and most preferably concentric with the longitudinal axis of closure plate 38, such that the force is evenly distributed to the closure plate. This valved vent tube arrangement can be advantageously used with any of the embodiments of the invention disclosed herein.

The outlet of the spout shown in FIGS. 6–7 also has a different vent tube support or spider than that shown in the preceding figures. In particular, the portion 415 of the spider that supports the vent tube is flared outward in the direction of fluid flow to defect the fluid outward in a cone shape as it passes out of the spout. This directs the fluid away from the vent tube and reduces the likelihood that exiting fluid will be sucked back up the vent tube. This is of particular advantage for spouts with vent tubes that are valved, and more particularly, for vent tubes that are valved with spring-loaded valves, such as those of FIGS. 6–7.

Figure 8:
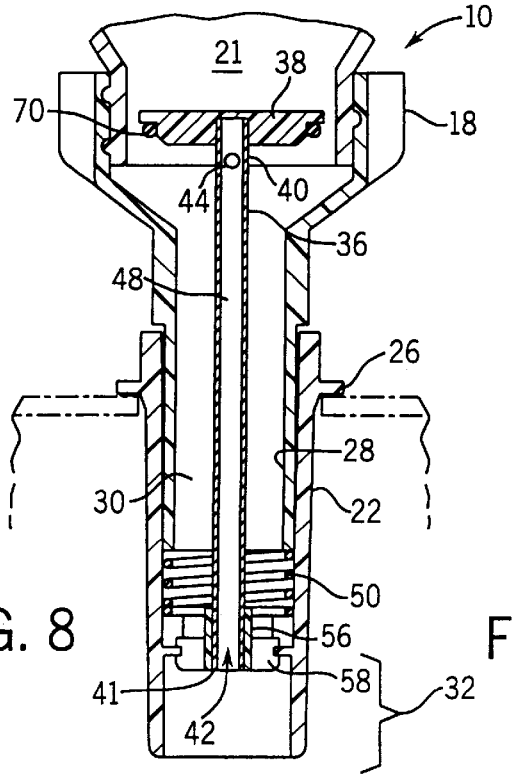
FIG. 8 is a sectional view of yet another embodiment of the spout shown in FIG. 2, illustrating a recessed vent tube.

FIG. 8 shows another embodiment of spout 10, similar to the embodiment of FIGS. 1–4, but having a vent tube recessed within actuating sleeve 22. When the container receiving the liquid is filled, the liquid level rises until it seals the opening of the actuating sleeve. At this point, air can no longer be drawn from the opening of the actuating sleeve into the vent tube since the opening is sealed off from its supply of air within the container by the liquid seal around the opening of the actuating sleeve. This reduces the likelihood of liquid being drawn upward into the vent tube and thus reduces the likelihood of the vent tube becoming filled with liquid and liquid-locked. When the spout is subsequently lifted from the opening of the now-filled container, it therefore reduces the likelihood that a liquid filled vent tube will drip fluid onto a surrounding surface. In applications where vapor and liquid leakage is a significant problem, such as liquid fuel cans such as gasoline cans, eliminating drips onto surrounding free surfaces will eliminate vaporization of fuel. This recessed vent tube arrangement can be applied to any of the embodiments wherein the vent tube is disposed within the actuating sleeve outlet.

Figure 9:
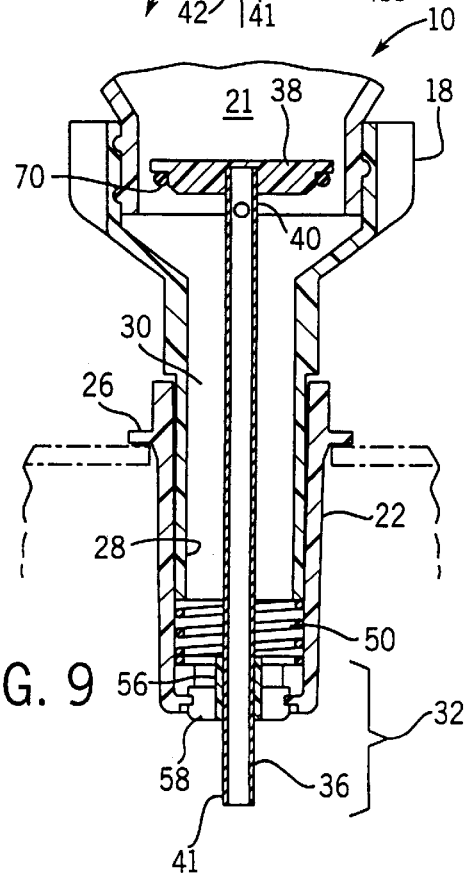
FIG. 9 is a sectional view of a further embodiment of the spout shown in FIG. 2, illustrating a protruding vent tube.

FIG. 9, shows another embodiment of spout 10 similar to the embodiment of FIGS. 1–4 but having a vent tube shown as protruding from the end of the actuating sleeve 22.

FIG. 10 illustrates an alternative embodiment of spout 10 similar to the arrangement of FIGS. 1–4 but having several significant differences. First, vent tube 236, which functions in the manner of the vent tubes described above, is formed integral with actuating sleeve 22. In the previous examples, vent tube 36 was formed separately from actuating sleeve 22 and was separately attached. In the example of FIG. 10, vent tube 236 has a length 416 that is formed integral with actuating sleeve 22, preferably by injection molding from a polymeric material. A collar 418 is formed on an end of length 416 and is configured to be coupled to second length 422 of vent tube 236 to which closure plate 138 is fixed. By forming a length 416 integral with actuating collar 22, the connection between vent tube 236 and the outlet of actuating collar can be reduced in size, thus permitting a larger area for fluid flow, as compared to the examples of the foregoing figures. Second length 422 of vent tube 236 is integrally formed with closure plate 38, preferably out of polymeric material, and the free end of second length 422 is fitted into collar 418 during assembly. In the FIG. 10 embodiment, the vent tube is assembled not by inserting a long vent tube all the way down to the bottom of the actuating collar and into a mounting hole at the outlet of the actuating collar, but by inserting a short vent tube partway down the actuating sleeve and attaching it to a stub portion of a vent tube that extends partway up the actuating sleeve. In effect, the vent tube attachment point has been moved. In the embodiment of FIG. 10, assembly personnel no longer have to guide a long vent tube to the very bottom of the actuating sleeve to attach it, such as they would have to do in all the preceding examples. This speeds assembly. This sectional vent tube arrangement can be advantageously employed with any of the embodiments of the invention.

Furthermore, by integrally forming vent tube 236 with the outlet of actuating sleeve 22, the spider can be reduced in size or eliminated, as shown here. This reduces the amount of material blocking the interior of actuating sleeve 22 and provides a larger exit area for liquid as compared to the preceding arrangements. This, in turn, provides a greater fluid flow rate through the spout. The integral formation of at least a portion of the vent tube with the actuating sleeve can be employed with any of the embodiments of the invention for which a higher flow rate is desired.

Another difference between the arrangement of FIG. 10 and the preceding embodiments is the disposition of the vent tube along the side of the actuating sleeve 22 with the vent tube inlet located above the fluid outlet of the spout when disposed in a pouring position. Unlike the previous arrangements, wherein the vent tube is positioned along a central axis of the actuating sleeve, the vent tube in this arrangement is positioned along an interior wall of the conduit. When pouring, the spout is preferably arranged at an angle of between 15 to 75 degrees of horizontal with the outlet lower than the inlet and the vent tube disposed along the inside upper surface of the spout. In this position, the actuating sleeve outlet is tilted down so fluid will run out of the container under gravity, with the fluid exit disposed below the inlet to the vent tube such that fluid exiting the outlet of the spout will fall downward and away from the vent tube. This reduces the likelihood that the vent tube will "inhale" fluid and become liquid-locked. Much as food containers such as ketchup bottles guide air into the containers along an upper interior surface of their necks when the bottle is tilted and the food is poured out, so this arrangement guides air along an upper surface of the conduit (through the vent tube) when the reservoir is tilted and liquid is poured from the spout. The vent tube exit is also disposed along the upward side of the conduit when the spout is tilted into a pouring position to guide the air exiting the outlet of the vent tube into the reservoir along an upward edge of closure plate 38. The arrangement of vent tube inlet above the spout's fluid outlet can be employed with any of the embodiments of the invention and in particular where the spout is to be disposed at an angle to pour out the contents of the reservoir.

Another difference between the embodiment of FIG. 10 and that of the preceding figures is in the provision of a supporting rib or strut 424 that extends outward from closure plate 38 and vent tube 236. Strut 424 joins vent tube 236 and closure plate 38, to reduce the risk of closure plate 38 bending away from its seat when in the closed position. Since vent tube is fixed to closure plate off-center, the forces applied to vent tube 236 and closure plate 38 by spring 50 are unbalanced. This tends to cause closure plate 38 to be bent away from its seat, thus permitting leakage around the closure plate. Strut 424 joins closure plate 38 and vent tube 236 to reduce this risk of leakage.

FIG. 11 illustrates a further embodiment of spout 10 similar to that of FIG. 10, but having a vent tube 36 separately coupled to both actuating sleeve 22 and closure plate 38. Vent tube 36 is preferably formed of a stronger material than both actuating sleeve 22 and closure plate 38, most preferably a metal, for example, brass. A separate vent tube as shown here is particularly important for applications wherein the sealing of closure plate 38 must be quite tight, for example, where reservoir 12 is used to store volatile hydrocarbon liquids, such as gasoline.

Figure 12:
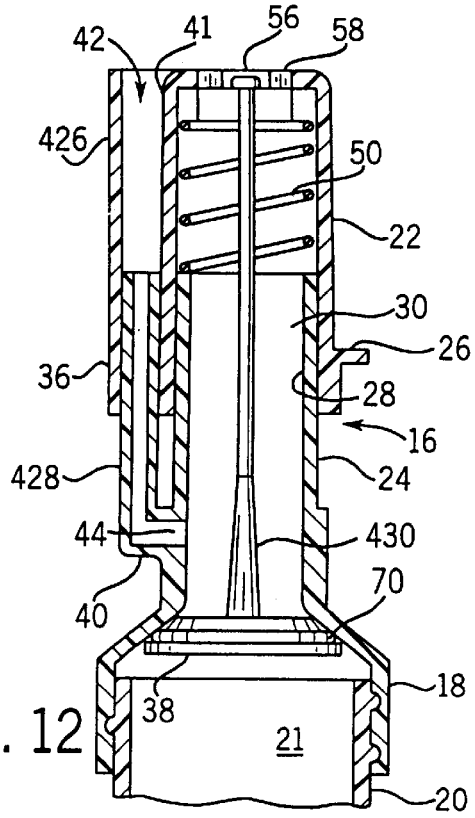
FIG. 12 is a sectional view of yet another embodiment of the spout shown in FIG. 2, illustrating an external vent tube.
Figure 13:
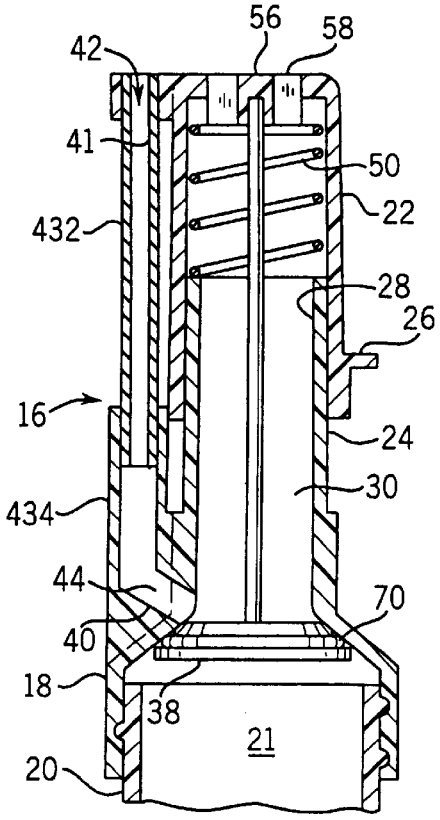
FIG. 13 is a sectional of an alternative embodiment of a spout shown in FIG. 12.

FIGS. 12 and 13 illustrate another embodiment of spout 10 wherein the vent tube is external to the conduit and is telescopic. The vent tube does not support closure plate, which is supported on a rod coupled to actuating sleeve 22.

In FIG. 12, vent tube 36 is formed as two telescopic sections, and inlet section 426 and an outlet section 428. Inlet section 426 is integrally formed with actuating sleeve 22 and is fixed to an outer side wall of sleeve 22. Outlet section 428 is integrally formed with base 24 and is fixed to an outer surface of base 24. As in the previous examples of spout 10 (not including those having separately valved vent tubes), the outlet of vent tube 36 is disposed downstream of closure plate 38, and thus is not in fluid communications with reservoir 12 when closure plate 38 is closed. Since vent tube portions 426 and 428 are fixed to actuating sleeve 22 and base 24, they are telescoped, one within the other, to permit them to slide in and out when actuating sleeve 22 is pressed toward base 24 to open closure plate 38. In the arrangements of the foregoing figures, the vent tube moved with the closure plate within the conduit portion of the spout. As a result, the outlet end of the vent tube moves with respect to base 24 and does not maintain an optimum position for air flow into reservoir 12. In contrast to this arrangement, vent tube 36 of FIG. 12 has an outlet with a fixed entry point into base 24—an entry point that does not move as closure plate 38 is opened and closed. This vent tube arrangement can be employed with any of the embodiments of the invention where an optimal air flow regime is desired.

In addition to the foregoing difference, the embodiment of FIG. 12 supports closure plate 38 on rod 430 instead of a vent tube, as in the previous examples. By replacing the vent tube of the previous examples with rod 430, the fluid flow path through base 24 and actuating sleeve 22 can be increased to permit a greater flow rate. Rod 36 is preferably fixed to the outlet end of spout 10 in spider 56.

FIG. 13 shows another embodiment of spout 10, similar to the embodiment of FIG. 12, wherein the vent tube portion 432 fixed to actuating sleeve 22 is telescoped inside vent tube portion 434 formed integrally with base 24.

This telescoping arrangement is the reverse of the FIG. 12 arrangement and provides for a smaller outlet end of spout 10. This, in turn, permits spout 10 to be inserted into a smaller container opening than the embodiment of FIG. 12. Furthermore, and unlike the FIG. 12 arrangement, vent tube portion 434 is separately attached to actuating sleeve 22. Vent tube portion 434 is preferably made of a light, durable metal, such as brass, which further reduces the size of the outlet of spout 10.

Referring now to FIGS. 14–16, there is illustrated a spout 10 for a container 12 including an end cap 37 coupled to the vent tube 36 at the inlet 42 and configured to fluidly seal the conduit 16 of the spout 10 in conjunction with the closed position of the closure plate 38. FIG. 14 illustrates an examplary embodiment of an end cap 37 in an open position and the closure plate 38 in the opened position. FIG. 15 illustrates an examplary embodiment of an end cap 37 sealing spout 10 and the closure plate 38 in a closed position. The end cap 37 can be utilized with any of the examplary embodiments described above to seal the spout 10 when a decanting operation of fluid from the-container 12 is completed.

In a decanting procecure the spout 10 is inserted into the opening 53 of a receiving vessel (see for example FIG. 4), the rim of the opening 53 pushes the actuating sleeve 22 back toward container 12 which compresses the spring 50 and opens the aperture 32 at the second end of the conduit 16 to allow fluid to flow through the lumen 30 of the conduit 16. Simultaneously, the closure plate 38 moves to an open position to allow fluid from the container 12 to move through the container opening 21 into the lumen 30 of the conduit 16 of the spout 10 to decant the fluid. The closure plate 38 is coupled to the vent tube 36 and the end cap 37 is also coupled to the vent tube 36. When the decanting procedure is completed, an operator removes the spoilt 10 from the opening 53 which allows the spring 50 to push the sleeve 22 away from the container 12 and close the aperture 32 with the end cap 37 sealing the conduit 16 of the spout 10 and simultaneously the closure plate 38 seals the opening 21 of the container 12 stopping the flow of fluid from the container 12. Any fluid in the lumen 30 of the conduit 16 of the spout 10 is contained between the end cap 37 and the closure plate 38 within the spout 10.

The end cap 37 can seal the conduit 16 either by abutting against the conduit 16 wall 28 as shown in FIG. 15 or the end cap 37 can be configured to seal the conduit 16 within the diameter 25 defined by the wall 28 of the conduit 16 as shown in FIG. 16. In either case, a fluid seal can be enhanced by the use of a gasket or o-ring 70 as shown in FIGS. 15 and 16. The composition of the various materials utilized in the spout 10 is as described above with the various examplary embodiments described herein. The end cap 37 can be manufactured from resilient, corrosive-resistant material such as nylon, acetal, HDPE, or an engineered high density plastic.

FIGS. 14–16 illustrate a spout 10 for a container 12 comprising a conduit 16 having a first end connected to the container 12, an aperture 32 and a second end configured to be inserted into an opening 53 (as illustrated in FIG. 4). The second end of the conduit 16 is configured to direct fluid axially out of the second end of the conduit 16. A closure plate 38 extending across the diameter 25 of the conduit 16 for preventing flow through the conduit 16 is provided proximate the first end of the conduit 16. The closure plate 38 has a closed position (See FIG. 15) to inhibit flow through the conduit 16 and an open position (see FIG. 14) to allow flow through the conduit 16. An opener or activating sleeve 22 is movably responsive to inserting the conduit 16 into the opening 53 to move the closure plate 38 from the closed position to the open position, with the sleeve 22 being spring 50 loaded to hold the closure plate 38 normally closed. A vent tube 36 having a passage 48 is coupled to and supports the closure plate 38 centrally disposed in the conduit 16 and the vent tube 36 is coupled to the opener sleeve 22. The sleeve 22 and the vent tube 36 can be coupled together by molding, crimping, adhesive, mechanical fastening and the like. The vent tube 36 has an inlet 42 and an outlet 44 with the inlet 42 disposed in the aperture 32 and opens into the conduit 16. The outlet 44 is disposed proximate and co-terminus with the second end of the conduit 16 and permits a flow of air from the inlet 42 into the vent passage 48 during a flow of fluid from the container 12 into the opening 53. An end cap 37 is coupled to the vent tube 36 at the inlet 42 and configured to fluidly seal the conduit 16 in conjunction with the closed position of the closure plate 38. Another embodiment of the spout 10 includes the end cap 37 being configured to seal the conduit 16 within the diameter 25 defined by the wall 28 of the conduit 16 (See FIG. 16). Another embodiment of the spout 10 provides the opener sleeve 22 and the vent passage 48 wall 36 are integrally formed as a single unit.

Referring now to FIGS. 17 and 18, FIG. 17 illustrates an exemplary embodiment of a container 12 without an air vent. A spout 10, such as the self-sealing spouts described above, can be coupled to a first cap 218, having a first depth portion 200, configured to couple with a first neck 220 having a first length portion 202 on the container 12. The linear dimension of the first depth portion 200 and the first length portion 202 are substantially equal to each other such that when the first cap 218 is threadingly coupled to the first neck 220 of the container 12 a fluid seal is effected between the rim of the neck 220 and that portion of the spout 10 which is inside the cap 218. A gasket or o-ring (not shown) can be used between the rim of the neck 220 and the spout 10 inside the cap 218.

FIG. 18 illustrates a side view of an exemplary embodiment of a container 12, with an air vent 315, with a conventional spout 10 coupled to a second cap 318, having a second depth portion 304, configured to threadingly couple with a second neck 320 having a second length portion 306 on the container 12. The linear dimension of the second depth portion 304 and the second length portion 306 are substantially equal to each other such that when the second cap 318 is threadingly coupled to the second neck 320 of the container 12 a fluid seal is effected between the rim of the neck 320 and that portion of the spout 10 which is inside the cap 318. A gasket or o-ring (not shown) can be used between the rim of the neck 320 and the spout 10 inside the cap 318.

By configuring the first and second caps 218, 318 to have a first depth portion 200 and second depth portion 204, respectively, together with providing a first neck 218 having a first length portion 202 and a second neck 320 having a second length portion 306, there is provided a method of preventing improper use of a spout 10 on a container 12 including the steps of providing the container 12 with one of a first neck portion 220 and a second neck portion 320 and, providing the container 12 with one of a first screw cap 218 having a first depth portion 200 and a second screw cap 318 having a second depth portion 304, wherein the first screw cap 218 will not couple with the second neck portion 320 to form a fluid seal between that neck portion 320 and the spout 10 and a second screw cap 318 will not couple with the first neck portion 220 to form a fluid seal between that neck portion 220 and the spout 10. For example, the first length portion 202 of the first neck 220 can be shorter than the second depth portion 304 of the second cap 318 such that if the second cap 318 is threaded onto the first neck, 220, the bottom edge of cap 318 will butt against the surface of the container 12 before the fluid seal is created between the top rim of the neck 220 and the spout 10 in the second cap 318. As will be appreciated, a corresponding situation will exist if the second length portion 306 of the second neck 320 is longer than the first depth portion 200 of the first cap 218 such that if the first cap 218 is coupled onto the second neck 320 of the container 12, a fluid seal will not be created between the top rim of the second neck 320 and the spout 10 in the first cap 218.

The Applicant has determined that a self-sealing spout, in the various embodiments described above, will not operate with a separate air vent 315 in the container 12. The Applicant believes that since a vacuum is formed in the ventless container, as described above, the Applicant must prevent the improper use of a self-sealing spout on a vented container (see FIG. 18) in order to have the self-sealing spout operate efficiently and effectively. Likewise, Applicant believes that a conventional spout, i.e., not a self-sealing spout, as illustrated in FIG. 18, will not operate efficiently or effectively in a ventless container. Using a conventional spout with a ventless container creates a situation (because of the partial vacuum) that facilitates the surging or "gulping" of the fluid being decanted from such ventless container. Therefore, the Applicant believes that preventing the improper use of a conventional spout with a ventless container was necessary. By configuring a cap for use with a self-sealing spout on a neck of a ventless container so that cap cannot be used on a vented container and likewise configuring a second cap for use with a second neck on a vented container and dimensioned to prohibit use on the first neck provides a method of preventing improper use of a particular spout with a particular container. In other words, the container 12 is provided with the first neck portion 220 and the first screw cap 218 if the container 12 does not have an air vent 315. However, if the container 12 is provided with an air vent 315, that container is provided with the second neck portion 320 and the second screw cap 318 and the caps and associated spouts are not interchangeable with the vented and ventless containers. Applicant believes that the spout 10 and caps 218, 318 can be marketed separate from the container 12 and therefore, the method of preventing improper use of the operative caps and spout was developed. It should also be understood that although external threads on the neck portions of the containers and internal thread portions on the first and second caps have been described, it is contemplated that other threading configurations can be utilized such as threading internal to the neck portions of the containers and external threading on the caps. It is also contemplated that a particular spout, either the self-sealing spout or the conventional spout is formed integrally as one piece with a cap for use with the respective containers.

Thus, it should be apparent that there has been provided in accordance with the present invention an improved spout that fully satisfies the objectives and advantages set forth above. Although the invention has been described in conjunction with specific embodiments thereof, it is evident that many alternatives, modifications and variations will be apparent to those skilled in the art. For example, the spout can be configured to engage the screw cap through an opening in the screw cap during use and reversing the orientation of the spout for storage within the container with the opening in the screw cap being sealed to secure the spout in the container. Another example provides the present spout coupled to a child-resistant closure with the closure having a clutch ring and clutch teeth to inhibit access to the contents of the container by a child but not to an adult. Accordingly, it is intended to embrace all such alternatives, modifications and variations that fall within the spirit and broad scope of the appended claims.

The embodiments of the invention in which an exclusive property or privilege is claimed are defined as follows:

1. A spout for a container comprising:

a conduit having a first end connected to the container, an aperture and a second end configured to be inserted into an opening, wherein the second end of the conduit is configured to direct fluid axially out of the second end of the conduit;

a closure plate extending across the diameter of the conduit for preventing flow through the conduit, the closure plate having a closed position to inhibit flow through the conduit and an open position to allow flow through the conduit;

a sleeve movably responsive to inserting the conduit into the opening to move the closure plate from the closed position to the open position, wherein the sleeve is spring loaded to hold the closure plate normally closed;

a vent tube having a passage is coupled to and supports the closure plate centrally disposed in the conduit, the vent tube having an inlet and an outlet, with the inlet disposed in the aperture and opens into the conduit and the outlet disposed co-terminus with the second end of the conduit and permitting a flow of air from the inlet into the vent passage during a flow of fluid from the container into the opening; and, an end cap coupled to the vent tube at the inlet and configured to fluidly seal the conduit in conjunction with the closed position of the closure plate.

2. The spout of claim 1, wherein the end cap is configured to seal the conduit within the diameter defined by the wall of the conduit.

3. A spout for a container comprising:

a conduit having a first end connected to the container, an aperture, a second end adapted to be inserted into an opening and a conduit wall connecting the first end and the second end;

a closure for preventing flow through the conduit, the closure having a closed position to inhibit flow through the conduit and an open position to allow flow through the conduit;

an opener movably responsive to inserting the conduit into the opening to move the closure from the closed position to the open position;

a vent tube having a passage having an inlet and an outlet, the inlet disposed within the aperture, with the vent tube having a passage wall between the inlet and the outlet and in contact with the conduit wall and the outlet disposed in the vent passage for permitting a flow of air through the inlet into the vent passage during a flow of fluid through the conduit from the container into the opening; and, an end cap coupled to the vent tube at the inlet and configured to fluidly seal the conduit in conjunction with the closed position of the closure.

4. The spout of claim 3, wherein the second end of the conduit is configured to direct fluid axially out of the second end of the conduit.

5. The spout of claim 4, wherein the closure includes a plate extending substantially entirely across the diameter of the conduit.

6. The spout of claim 5, wherein the opener is spring loaded to hold the closure normally closed.

7. The spout of claim 6, wherein the vent passage inlet opens into the conduit.

8. The spout of claim 7, wherein the vent passage outlet is substantially co-terminus with the second end of the conduit.

9. The spout of claim 8, wherein the vent passage is centrally disposed in the conduit.

10. The spout of claim 9, wherein the vent passage is coupled to and supports the closure plate.

11. The spout of claim 3 wherein the end cap is configured to seal the conduit within the diameter defined by the wall of the conduit.

12. A spout for a container comprising:

a conduit having a first end connected to the container, an aperture and a second end configured to be inserted into an opening, and a conduit wall connecting the first end and the second end wherein the second end of the conduit is configured to direct fluid axially out of the second end of the conduit;

a closure plate extending across the diameter of the conduit for preventing flow through the conduit, the closure plate having a closed position to inhibit flow through the conduit and an open position to allow flow through the conduit;

an opener movably responsive to inserting the conduit into the opening to move the closure plate from the closed position to the open position, wherein the opener is spring loaded to hold the closure normally closed;

a vent tube having a passage coupled to and supports the closure plate centrally disposed in the conduit, the vent passage having an inlet and an outlet and a passage wall between the inlet and outlet and external to the conduit wall, with the inlet disposed in the aperture and opens into the conduit and the outlet disposed co-terminus with the second end of the conduit and permitting a flow of air from the inlet into the vent passage during a flow of fluid from the container into the opening; and an end cap coupled to the vent tube at the inlet and configured to fluidly seal the conduit in conjunction with the closed position of the closure plate.

13. The spout of claim 12, wherein the opener and vent passage wall are integrally formed as a single unit.

14. The spout of claim 12 wherein the end cap is configured to seal the conduit within the diameter defined by the wall of the conduit.

15. A spout for a container comprising:

a means for conducting having a first end connected to the container, an aperture and a second end configured to be inserted into an opening, wherein the second end of the means for conducting is configured to direct fluid axially out of the second end of the means for conducting;

a means for closing extending across the diameter of the means for conducting for preventing flow through the means for conducting, the means for closing having a closed position to inhibit flow through the means for conducting and an open position to allow flow through the means for conducting;

a means for opening movably responsive to inserting the means for conducting into the opening to move the means for closing from the closed position to the open position, wherein the means for opening is spring loaded to hold the means for closing normally closed; and, a means for venting having a passage is coupled to and supports the means for closing centrally disposed in the means for conducting, the means for venting having an inlet and an outlet, with the inlet disposed in the aperture and opens into the means for conducting and the outlet disposed co-terminus with the second end of the means for conducting and permitting a flow of air from the inlet into the vent passage during a flow of fluid from the container into the opening.

16. The spout of claim 15, including a means for capping coupled to the means for venting at the inlet and configured to fluidly seal the means for conducting in conjunction with the closed position of the means for closing.

17. The spout of claim 16, wherein the means for capping is configured to seal the means for conducting within the diameter defined by the wall of the means for conducting.

* * * * *